United States Patent [19]

Weyerstall et al.

[11] Patent Number: 4,948,184

[45] Date of Patent: Aug. 14, 1990

[54] MOTOR VEHICLE DOOR LOCK

[75] Inventors: Bernd Weyerstall, Wuppertal; Klaus Claar, Sindelfingen; Jan Schilling, Gechingen, all of Fed. Rep. of Germany

[73] Assignees: Bomoro Bocklenberg & Motte GmbH & Co. KG, Wuppertal; Daimler-Benz AG, Stuttgart, both of Fed. Rep. of Germany

[21] Appl. No.: 297,397

[22] Filed: Jan. 17, 1989

[30] Foreign Application Priority Data

Jan. 21, 1988 [DE] Fed. Rep. of Germany ..... 3801581

[51] Int. Cl.[5] ..... E05C 3/26

[52] U.S. Cl. ..... 292/216; 292/DIG. 23; 292/201

[58] Field of Search ..... 292/216, 201, 341.16, 292/DIG. 43, DIG. 23, 210, 198

[56] References Cited

U.S. PATENT DOCUMENTS

| | | | |
|---|---|---|---|
| 3,334,934 | 8/1967 | Sandor | 292/216 |
| 3,386,761 | 6/1968 | Johnstone et al. | 292/216 |
| 3,504,511 | 4/1970 | Allen | 292/DIG. 43 |
| 4,203,621 | 5/1980 | Noel et al. | 292/216 |
| 4,783,102 | 11/1988 | Bernard | 292/216 |
| 4,815,775 | 3/1989 | Mertin et al. | 292/216 |

FOREIGN PATENT DOCUMENTS

| | | |
|---|---|---|
| 3409996 | 9/1985 | Fed. Rep. of Germany . |
| 2155535A | 9/1985 | United Kingdom . |

*Primary Examiner*—Eric K. Nicholson

*Attorney, Agent, or Firm*—Sixbey, Friedman, Leedom & Ferguson

[57] ABSTRACT

Motor vehicle door lock or the like with a pivotally mounted locking catch (3), a pivotally mounted pawl (4) which blocks the locking catch (3) in a preliminary locking position and a main locking position, and with a locking mechanism (5) for operating the locking catch (3) and pawl (4). The locking mechanism (5) has an outside release lever (6), and when outside release lever (6) is operated, pawl (4) can swing into a release position freeing locking catch (3), e.g., by being lifted. The manipulation of the lock is improved since, in the opening movement, when the locking catch (3) is in the main locking position and the release lever (6) is operated, the pawl (4) is swung into the release position, where it is retained independently of the further operation condition of outside release lever (6) until the locking catch (3) has passed the preliminary locking position.

5 Claims, 4 Drawing Sheets

MOTOR VEHICLE DOOR LOCK

BACKGROUND OF THE INVENTION

The invention relates to a motor vehicle door lock or the like of the type having a pivotally mounted locking catch, a pivotally mounted pawl for blocking the locking catch and a lever actuated locking mechanism for operating the catch and pawl.

German Patent No. 34 09 996 discloses a vehicle door lock of the above type wherein a motor operated locking aid is provided. This known lock is particularly suitable as a door lock for the tailgate of a station wagon but, in its basic function, can also be used as a side door lock or as a hood lock. For reasons of safety, in motor vehicle door locks, it is a standard specification to provide the locking catch with a preliminary locking position (prestop) and a main locking position (main stop). While only slight locking forces occur when bringing the locking catch into the preliminary locking position, relatively large locking forces, caused by the circumferential door seal, occur along the path between the preliminary locking position and the main locking position. In the known motor vehicle door lock, the locking catch can easily be brought into the preliminary locking position by closing the respective door by hand, while the catch is brought from the preliminary locking position to the main locking position by a motor-operated locking aid, i.e., by means of an auxiliary motor. This is certainly technically practical and convenient.

In opening a motor vehicle door lock, particularly a tailgate lock, by operating an outside release lever, it is possible that the locking catch does not immediately reach the opening position, since unintentionally letting go of the outside release lever will cause the pawl to fall into the preliminary locking position, thereby blocking the locking catch once again. In the case of a motor vehicle door lock that is not equipped with a motor-operated locking aid, this circumstance requires operating of the outside release lever again, which is often considered bothersome. This situation frequently occurs in the case of outside release levers that are operated by push buttons, as are often used on motor vehicle door locks for tailgates of station wagons.

In the case of a motor vehicle door lock having a motor-operated locking aid in which, as usually occurs, the auxiliary motor is turned on by the pawl falling into the preliminary locking position, the above described operating sequence leads to the motor-operated locking aid being operated again in the closing direction so that the door will be unintentionally pulled shut again. In a motor vehicle door lock with a motor-operated locking aid, this effect is, thus, very especially annoying.

Finally, in the case of side doors of motor vehicles with very high comfort requirements, an annoying impact noise can also be perceived during closing of the door as the pawl snaps down over the two flanges of the locking catch, which is made as a forked catch.

SUMMARY OF THE INVENTION

In view of the foregoing, a primary object of the invention is to improve the opening movement manipulation of a motor vehicle door lock.

A specific object is to provide a motor vehicle door lock wherein the pawl, once moved into a released position, upon operating of the release lever, is prevented from shifting back into a latching position until the locking catch had passed the preliminary locking position.

According to a preferred embodiment of the invention, the above object is achieved by causing the pawl to be swung into the release position by the outside release lever, with a special action being triggered when said locking catch, at this instance, is in its main locking position, namely, a blocking of the pawl until the locking catch has passed the preliminary locking position. Optionally, the same function may be triggered by an inside release lever, if an inside release lever is present at all. This is not always the case with tailgates of station wagons.

Thus, in normal opening of the door, the pawl is first swung into the release position from the outside, so that the locking catch is released. But now the pawl, in a way that differs from the prior art, is held in the release position, independently of the further operating condition of the outside release lever, even when a corresponding outside pressure locking cylinder or the like is provided. The locking catch can pass the preliminary locking position unhindered and swing completely into the opening position. Consequently, it is systematically ruled out that the pawl is unintentionally "hooked" in the preliminary locking position, so that the initially explained unpleasant consequences are systematically prevented.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Figure 1:
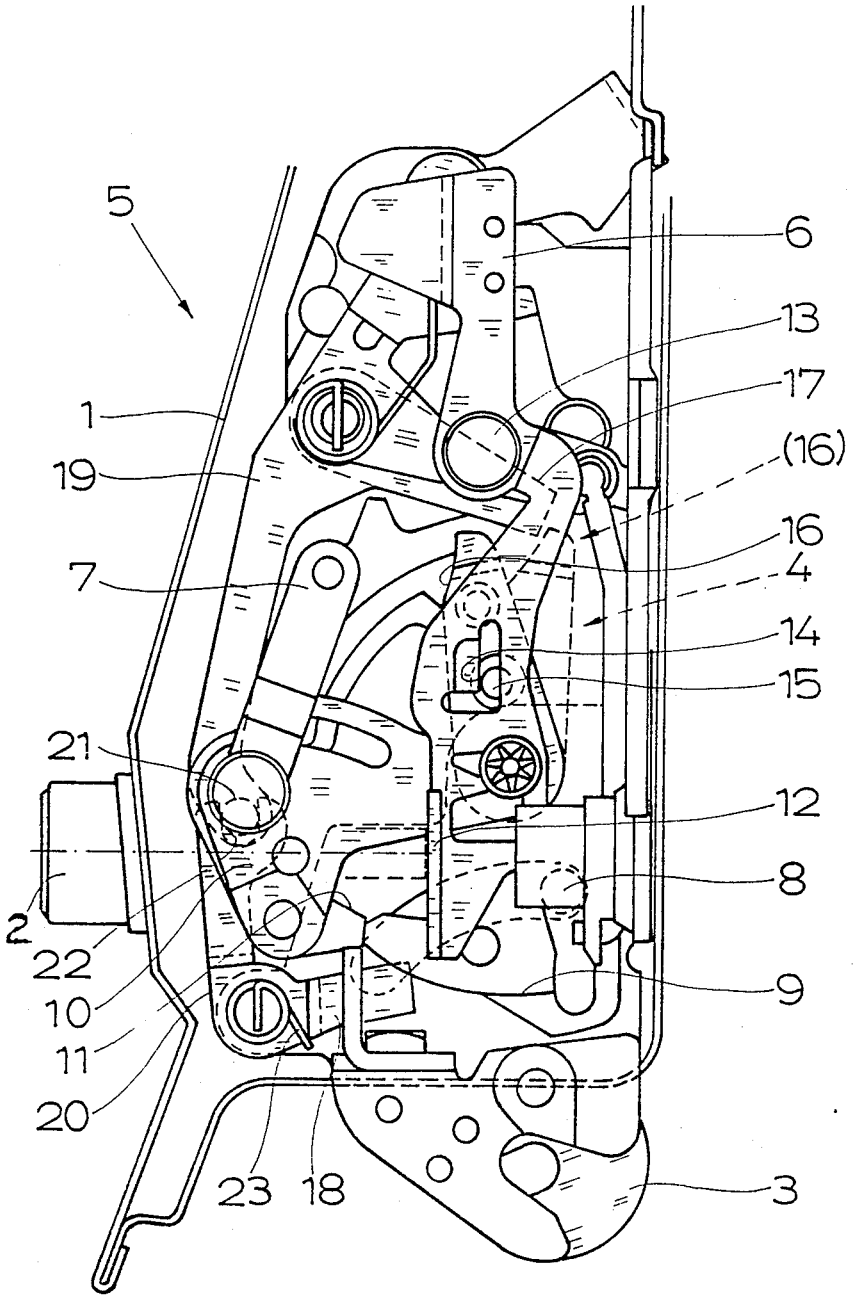
FIG. 1 of the drawings shows, in diagrammatic representation, a motor vehicle door lock according to the invention in a preferred embodiment for the tailgate of a station wagon in the main locking position.
Figure 2:
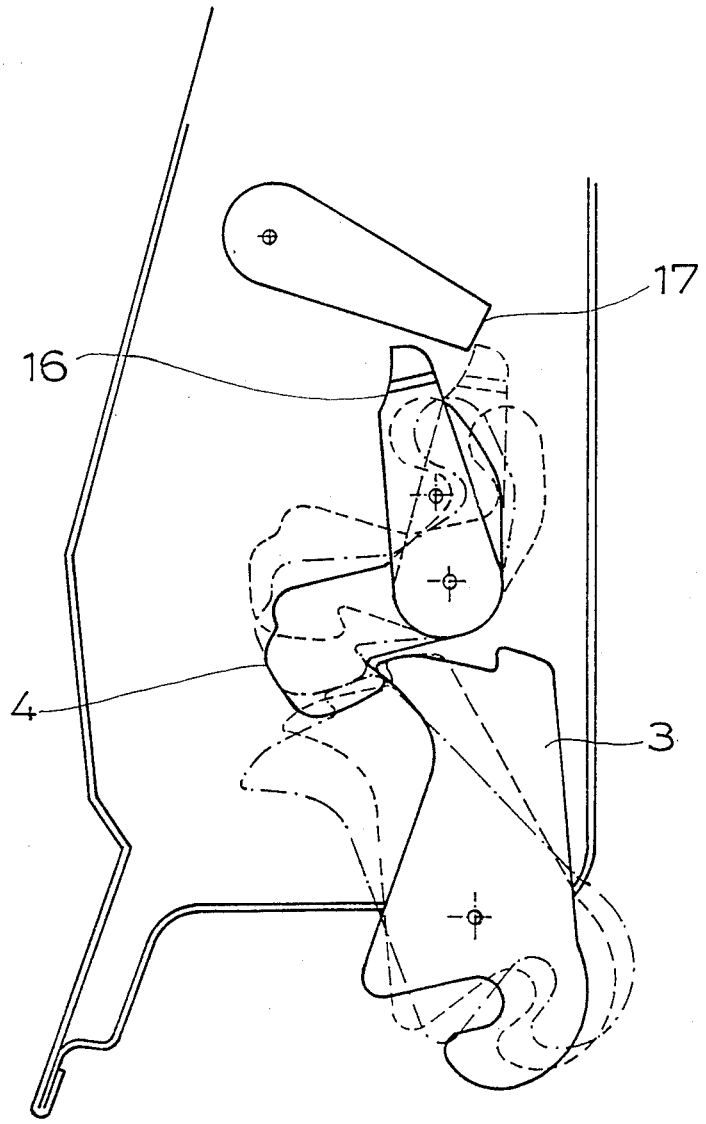
FIGS. 2 through 4 of the drawings show the catch and the pawl in different relative positions.
Figure 3:
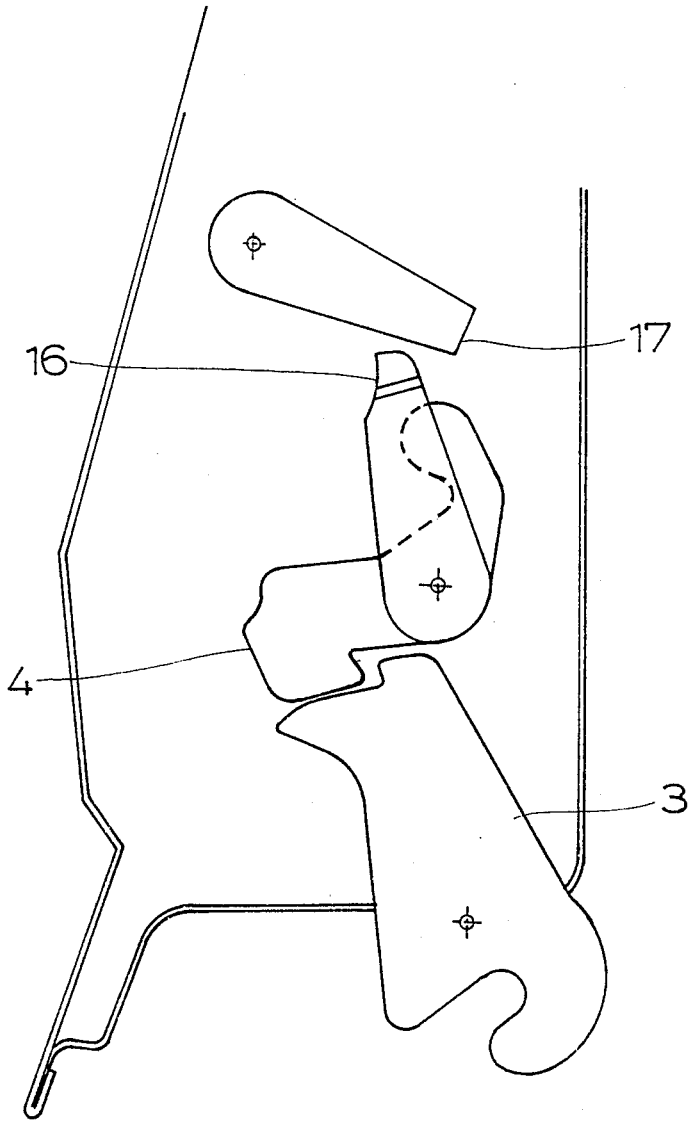

The motor vehicle door lock according to the invention can be used not only, as represented for tailgate 1 of a station wagon, but also in appropriate adaptation on the locking design, for side doors, hoods, etc. On tailgate 1, a pressure locking cylinder 2 can be seen, by which the outside operation of the door lock takes place. A clamp on the door frame, gripped by a locking catch of the motor vehicle door lock in tailgate 1, is not represented. On the other hand, a locking catch 3 can easily be seen, which in the embodiment represented here is designed as a pivotally mounted forked catch. A pawl 4, which is also mounted to swing, serves for blocking locking catch 3 in the locking positions, i.e. both in a preliminary locking position and in a main locking position. In FIG. 1 the pawl 4 is not to be seen clearly, because it is positioned in a plane below the drawing plane. FIG. 2, however, shows the pawl 4 and the catch 3 in the main locking position (full lines), whereas FIG. 3 shows the pawl 4 in the preliminary locking position. A locking mechanism 5 constitutes a means for operation of locking catch 3 and pawl 4. The individual parts of locking mechanism 5 are explained, below, only to the extent that they are significant for an understanding of the invention, other aspects thereof corresponding to conventionally well-known mechanism of this type.

First, locking mechanism 5 has an outside release lever 6. While not represented, an inside release lever, generally, is also provided, which in the illustrated embodiment could easily act on outside release lever 6 and could go into action in the same way as the outside release lever. According to a preferred embodiment of the invention the motor vehicle door lock represented here has a locking mechanism 5 that, moreover, is provided with an auxiliary motor in driving connection with locking catch 3, for displacing the locking catch 3 from the preliminary locking position into the main locking position. In the figure, only an output crank 7 of the motor is represented. The details as to the connection by which the auxiliary motor is coupled to output crank 7 and what kind of auxiliary motor is involved, e.g., electric motor, pneumatic motor, hydraulic motor, etc. is not critical and forms no part of the invention, per se, being achievable in any known manner.

However, for a better understanding of the lock design represented, it is pointed out that in the illustrated motor vehicle door lock, lock mechanism 5 has a link 10, which is pivotally connected to output crank 7, that acts on a drive pin 8 of locking catch 3 via an interposed auxiliary link 9. A releasable coupling, having a moving power transmission element 11 between link 10 and auxiliary link 9, is provided between output crank 7 and locking catch 3, i.e., drive pin 8 of locking catch 3. Power transmission element 11 can be swung manually from an operating position coupling link 10 with auxiliary link 9 (represented in the Figure) into a release position, and vice versa. Further, it is shown in broken lines how pressure locking cylinder 2 acts directly on a power transmission plate 12 on outside release lever 6, so that the lever 6 can be pivoted counterclockwise around its pivot pin 13 to open the door. When outside release lever 6 swings it operates, by a corresponding control surface 14, a drive pin 15 of pawl 4, so that pawl 4 pivots into the release position, i.e., it is lifted from the catch 3.

As is customary with a motor vehicle door lock having a motor-operated locking aid, in the illustrated embodiment, the auxiliary motor can be turned on by falling of pawl 4 into the preliminary locking position so that locking catch 3 can then be swung into the main locking position by the power train comprised of output crank 7, link 10, power transmission element 11, auxiliary link 9 and drive pin 8. In the main lock locking position, pawl 4 falls into a main stop and blocks locking catch 3.

It is now essential that, with locking catch 3 in the main locking position, operation of outside release lever 6, or optionally also the inside release lever, will swing pawl 4 into the release position, where it will be retained, independently of the further operation condition of the outside release lever 6 (or the inside release lever), until locking catch 3 has passed the preliminary locking position, when it will be released again, for the reasons noted above.

Figure 4:
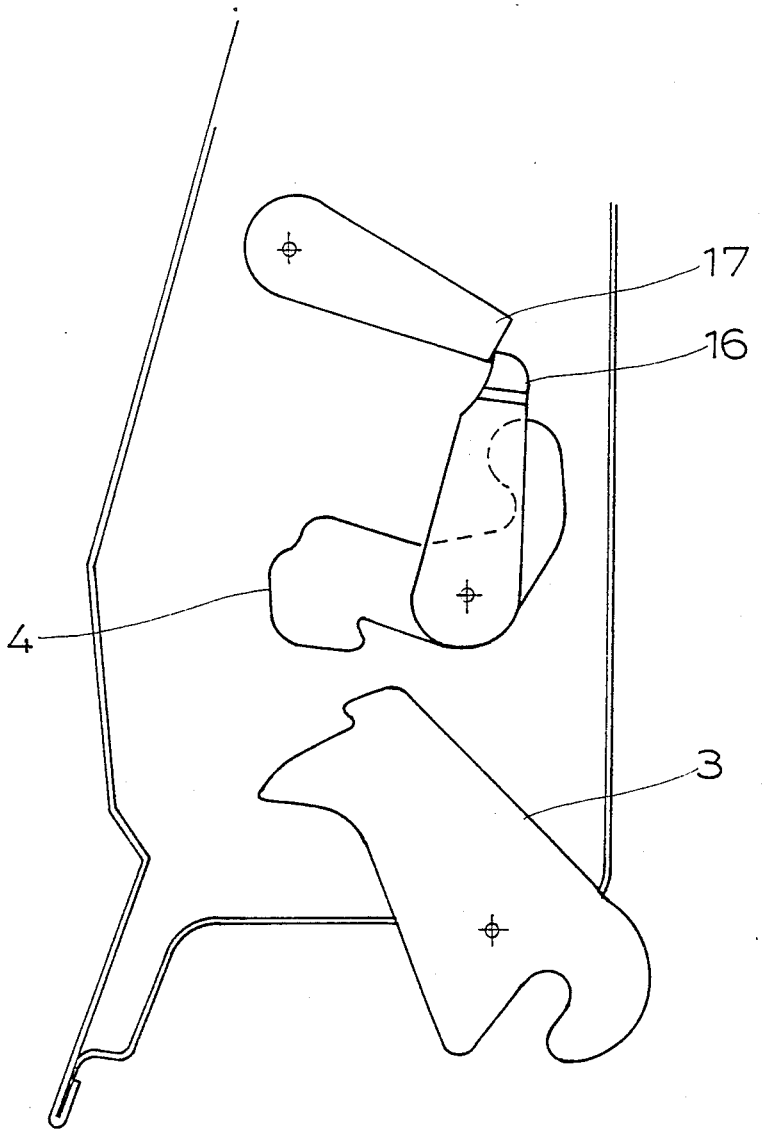

In the embodiment illustrated in FIG. 2, pawl 4 is kept in the release position until locking catch 3 passes the preliminary locking position (dashed lines) and reaches the open position . When locking catch 3 has reached the open position, pawl 4 is again released and, by the usual spring loading, can swivel into the position from which, when the door is closed again, the pawl 4 will fall by itself first into a preliminary stop and then into the main stop on locking catch 3 (dash-dotted lines in FIG. 2). The movement of pawl 4 with regard to locking catch 3 corresponds in that respect to the normal sequence during closing of the door. If no motor-operated locking aid is provided or if the motor-operated aid is turned on in a way other than by falling of pawl 4 into the preliminary stop, it is even possible for the pawl 4 to be held in the release position until the locking catch 3 has again reached the main locking position. This is seen in FIG. 4 of the drawings showing the pawl 4 still in its release position with the catch 3 in its open position. Relative to the initially explained question of comfort, this has the advantage that no impact noise occurs as the pawl 4 does not fall into the preliminary locking position during closing of the door.

Basically there are all kinds of design possibilities to achieve holding of pawl 4 in the release position. For example, a timing circuit may be incorporated into the locking mechanism 5, for example, a mechanical, hydraulic or pneumatic timing circuit, by which, after operation of the outside, release lever, the pawl is held in the release position for a certain preset period, which is sufficient to let the locking catch swing through the preliminary locking position into the opening position.

However, according to the especially preferred embodiment of the invention represented in the drawing, pawl 4, or a component coacting therewith such as drive pin 15 of pawl 4 or an auxiliary lever 16 coupled with pawl 4 or with drive pin 15, is blocked in the release position of pawl 4 by a blocking lever 17 that has fallen, advantageously pivoted, into the movement path of pawl 4 or its coacting component. The position of auxiliary lever 16 that is represented in solid line in the drawing is the main locking position prior to operation of outside release lever 6. When outside release lever 6 is operated, auxiliary lever 16 shifts into the position represented in broken lines, in which it is blocked by blocking lever 17. Coupling of pawl 4 and auxiliary lever 16 takes place by drive pin 15, whose function has already been explained above.

The movement of blocking lever 17 in the movement path of auxiliary lever 16 can take place in a mechanically controlled way, for example, by a transmission lever. However, in the illustrated embodiment blocking lever 17 is spring-loaded in a direction so that it snaps past pawl 4 as it moves into the release position or past drive pin 15 or auxiliary lever 16.

FIG. 1 of the drawing also shows a specific arrangement by which pawl 4 is released by the swinging of locking catch 3 into the opening position. The design represented here shows that, for this purpose, blocking lever 17 has a stop arm 18 which projects into the movement path of locking catch 3 or of the drive pin 8 of locking catch 3, and by operation of the stop arm 18 the lever 17 can be moved, preferably swung, from the position blocking auxiliary lever 16 into the release position. Where stop arm 18 projects into the movement path of locking catch 3 or drive pin 8 depends on the position at which pawl 4 is to be shifted from the release position. The position of stop arm 18 illustrated in FIG. 1 corresponds to one where the pawl 4 is kept in the release position until the locking catch 3 has reached the open position (FIG. 2). On the other hand, if the pawl 4 is to be kept in the release position until the locking catch 3 again reaches the main locking position (FIG. 4), the stop arm 18 must lie on the other end of the movement path of drive pin 8.

Blocking lever 17 provided according to the invention can be of a one-piece construction that is pivotally mounted in locking mechanism 5. However, according to the illustrated preferred embodiment of the invention, blocking lever 17 is made of a multipart construction, preferably comprising a transmission lever 19 that coacts with pawl 4, or drive pin 15, or auxiliary lever 16, and a reversing lever 20 having the stop arm 18. In this form of lever 17, the respective free arms of transmission lever 19 and reversing lever 20 mesh with one another, preferably via a pin 21 and a slot 22.

Further, transmission lever 19 may have a blocking stop reinforcement resting on auxiliary lever 16, a reinforcement which, only for reasons of production engineering, is spotwelded separately on transmission lever 19.

Finally, FIG. 1 shows that, in the preferred embodiment, spring loading of blocking lever 17 is produced by a spring 23 that is placed on reversing lever 20. Spring 23 prestresses reversing lever 20 in the direction on the movement path of drive pin 8 of locking catch 3 and transmission lever 19 into the illustrated position represented in the sole Figure, i.e., past pawl 4 into the release position as described above.

While we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. Motor vehicle door lock comprising a pivotally mounted locking catch, a pivotally mounted pawl, said pawl blocking the locking catch in a preliminary locking position and a main locking position, and a locking mechanism for operating the locking catch and pawl, said locking mechanism having at least one release lever for swinging the pawl into a release position freeing the locking catch, and means for retaining the pawl in said release position, independent of further operation of the release lever, until said locking catch has been shifted from said main locking position and has passed the preliminary locking position, and for freeing said pawl from its release position thereafter, said means for retaining being operative only when said pawl is moved into said release position with the locking catch in its main locking position said means for retaining comprising a blocking lever pivotally mounted for swinging into a blocking position in a path of movement of at least one of the pawl and a component coacting with said pawl, such that said pawl is retained in said release position when said blocking lever is in said blocking position;

said blocking lever including a stop arm which projects into the path of movement of at least one of the locking catch and a drive pin on the locking catch, whereby said blocking lever is swung by displacement of said stop arm, from said blocking position into a position in which the pawl is freed;

wherein said blocking lever comprises a multipart construction which includes a transmission lever for interacting with one of said pawl and said component, and a reversing lever, said reversing lever comprising said stop arm.

2. Motor vehicle door lock according to claim 1, wherein respective free arms of the transmission lever and reversing lever mesh with one another.

3. Motor vehicle door lock according to claim 2, wherein the free arms of the transmission lever and the reversing lever mesh with one another by a pin and a slot.

4. Motor vehicle door lock according to claim 1, wherein said blocking lever is spring-loaded toward said blocking position in a manner enabling it to snap past said pawl or said component coacting therewith as the pawl moves into the release position.

5. Motor vehicle door lock according to claim 4, wherein the spring loading of the blocking lever is produced by a spring placed on said reversing lever.

* * * * *